US010015611B2

(12) United States Patent
Prokisch et al.

(10) Patent No.: US 10,015,611 B2
(45) Date of Patent: Jul. 3, 2018

(54) LOUDSPEAKER

(71) Applicant: Harman Becker Automotive Systems GmbH, Karlsbad (DE)

(72) Inventors: Joerg Prokisch, Karlsbad (DE); Robert Obermaier, Karlsbad (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/118,764

(22) PCT Filed: Feb. 5, 2015

(86) PCT No.: PCT/EP2015/052454
§ 371 (c)(1),
(2) Date: Aug. 12, 2016

(87) PCT Pub. No.: WO2015/124437
PCT Pub. Date: Aug. 27, 2015

(65) Prior Publication Data

US 2017/0055094 A1 Feb. 23, 2017

(30) Foreign Application Priority Data

Feb. 19, 2014 (DE) ..... 20 2014 001 433 U

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 31/00*** | (2006.01) |

(52) U.S. Cl.
CPC ..... *H04R 31/006* (2013.01); *H04R 9/06* (2013.01)

(58) Field of Classification Search
CPC ..... H04R 31/006; H04R 9/06
USPC ..... 381/433
See application file for complete search history.

(56) References Cited

U.S. PATENT DOCUMENTS 3,614,335 A 10/1971 Edgware et al.
4,281,224 A * 7/1981 Castagna ..... B60R 11/0217 181/150
5,150,419 A * 9/1992 Kizak ..... H04R 1/025 381/412
5,243,151 A * 9/1993 Prokisch ..... H04R 9/02 181/171

(Continued)

FOREIGN PATENT DOCUMENTS

DE 1950188 A1 5/1971
DE 8016205 U1 9/1980

(Continued)

OTHER PUBLICATIONS

International Search Report for Application No. PCT/EP2015/052454, dated Apr. 22, 2015, 10 pages.

*Primary Examiner* — Sean H Nguyen
(74) *Attorney, Agent, or Firm* — Brooks Kushman P.C.

(57) ABSTRACT

Disclosed is a loudspeaker comprising a loudspeaker frame and a magnet to which the loudspeaker frame is attached, characterized in that the magnet has a conical outer surface, the loudspeaker frame has a conical inner surface designed to form a press fit with the conical outer surface of the magnet, the magnet includes an undercut, and the loudspeaker frame includes a number of snap-on hooks, at least one of which engages with the undercut in the press-fit state.

22 Claims, 2 Drawing Sheets

(56) References Cited

U.S. PATENT DOCUMENTS

| | | | | |
|---|---|---|---|---|
| 5,319,337 | A * | 6/1994 | Matsunari | G03G 15/0921 335/303 |
| 5,535,980 | A * | 7/1996 | Baumgartner | B29C 33/56 106/38.2 |
| 2002/0044671 | A1* | 4/2002 | Shimomura | H04R 9/02 381/386 |
| 2002/0114473 | A1* | 8/2002 | Kuwabara | H04R 9/06 381/87 |
| 2009/0052725 | A1* | 2/2009 | Oda | H04R 9/06 381/412 |
| 2011/0135111 | A1* | 6/2011 | Suzuki | H04R 7/20 381/86 |

FOREIGN PATENT DOCUMENTS

| | | |
|---|---|---|
| FR | 952642 | 11/1949 |
| GB | 1069120 | 5/1967 |

* cited by examiner

LOUDSPEAKER

CROSS-REFERENCE TO RELATED APPLICATIONS

This application is the U.S. national phase of PCT Application No. PCT/EP2015/052454 filed on Feb. 5, 2015, which claims priority to DE Application No. 202014001433.7 filed on Feb. 19, 2014, the disclosures of which are incorporated in their entirety by reference herein.

TECHNICAL FIELD

The present invention relates to a loudspeaker.

BACKGROUND

From DE 1 950 188 A1, a loudspeaker comprising a loudspeaker frame and a magnet is known. DE 80 16 205 U1 discloses a loudspeaker comprising a loudspeaker frame, a top plate and a permanent magnet. The top plate has hollow rivets for mounting the loudspeaker frame to the upper side, which are formed by pressing recesses in on the opposite side of the top plate. The permanent magnet is then glued to the underside of the top plate.

SUMMARY

The object of the invention is to provide a loudspeaker that enables the most rapid production possible.

This object is attained by means of a loudspeaker having the features of independent claim 1. Advantageous developments are the subject matter of the dependent claims and are contained in the description.

A loudspeaker comprising a loudspeaker frame and a magnet is therefore provided.

The loudspeaker frame is fixed to the magnet.

The magnet has a conical outer surface. If the conical outer surface is designed as part of a truncated cone, this conical outer surface can also be referred to as the lateral surface.

The loudspeaker frame has a conical inner surface. The conical inner surface is embodied to form a press fit with the conical outer surface of the magnet. In a press fit, the conical inner surface of the loudspeaker frame is pressed onto the conical outer surface of the magnet.

The magnet has at least one undercut. The loudspeaker frame has a number of snap-in hooks. In a press fit, at least one snap-in hook engages into the undercut.

A multiplicity of advantages are achieved through specific configurations, as will be described in reference to the embodiments shown in the figures. The engagement of the snap-in hook into the undercut in the magnet prevents the loudspeaker frame from separating from the magnet. However, the assembly of the attachment between loudspeaker frame and magnet can be implemented in a single movement by producing the press fit. This method of attaching magnet to loudspeaker frame allows the cycle times for production to be significantly reduced, thereby allowing productivity to be increased significantly over other methods of attachment such as injection, for example.

The developments specified in the following further improve the mechanical strength of the connection and the speed of the assembly process.

According to one embodiment, the conical inner surface of the loudspeaker frame is produced by injection molding.

According to another embodiment, a wall is formed as integral with the conical inner surface and the at least one snap-in hook of the loudspeaker frame.

According to another embodiment, a wall having the conical inner surface and the at least one snap-in hook of the loudspeaker frame is made of a plastic material, in particular polycarbonate with 10% glass fibers.

According to another embodiment, the wall thickness of the loudspeaker frame in the region of the conical inner surface is greater than the wall thickness of the snap-in hook.

According to another embodiment, the snap-in hooks are formed adjacent to the conical inner surface of the loudspeaker frame.

According to another embodiment, the conical outer surface of the magnet is produced by turning.

According to another embodiment, the conical inner surface of the loudspeaker frame is produced by injection molding.

According to another embodiment, the material of the magnet in the region of the conical outer surface is harder than the material of the loudspeaker frame in the region of the conical inner surface. The material of the loudspeaker frame is then deformed in the region of the press fit by means of the press fit.

The further developments described above are particularly advantageous both individually and in combination. All of these further developments may be combined with one another. Some of the possible combinations will be detailed in the description of the embodiments shown in the figures. However, these possible combinations of development variants shown in the figures are not exhaustive.

BRIEF DESCRIPTION OF THE DRAWINGS

In the following, the invention will be specified in greater detail in the context of embodiment examples, with reference to the drawings.

The drawings show

DETAILED DESCRIPTION

Figure 1:
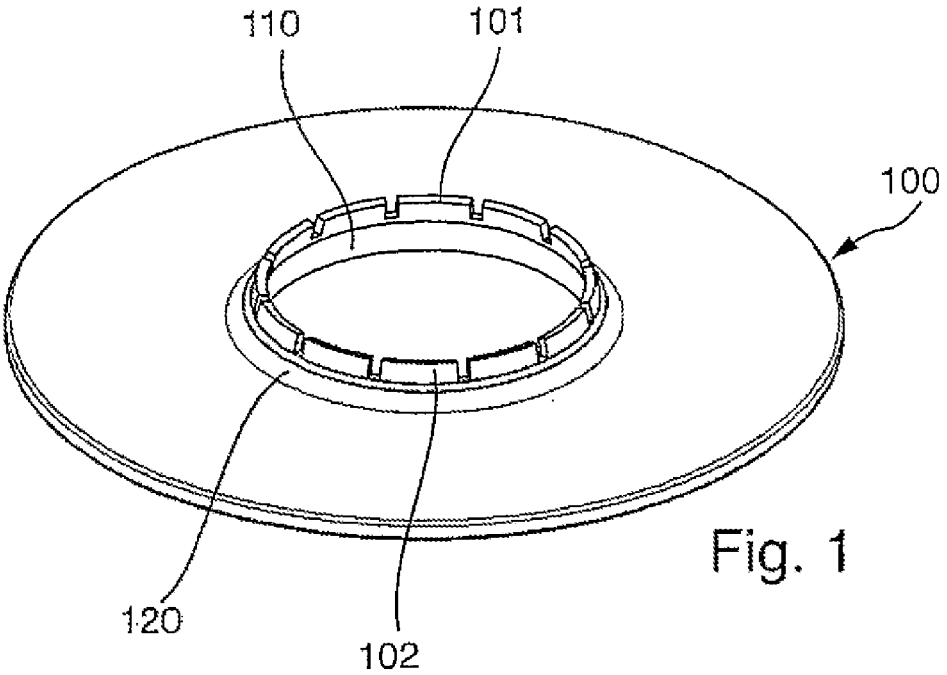
FIG. 1 a three-dimensional schematic view of a component of a loudspeaker frame, FIG. 2 a schematic cross-section of a component of a loudspeaker frame, FIG. 3 a schematic cross-section of a magnet, and FIG. 4 an enlarged schematic detail of a cross-section of a magnet.

FIG. 1 shows a schematic isometric view of a component of a loudspeaker frame 100 of a loudspeaker. Loudspeaker frame 100 has a conical inner surface 110. In the embodiment of FIG. 1, a number of snap-in hooks 101, 102 are formed adjacent to the conical inner surface 110. In an embodiment of FIG. 1, snap-in hooks 101, 102 are arranged rotationally symmetrically. In the embodiment of FIG. 1, snap-in hooks 101, 102 are arranged adjacent to the conical inner surface 110 around the entire circumference. Snap-in hooks 101, 102 may be made of an elastic material, such as plastic or metal. In an embodiment of FIG. 1, snap-in hooks 101, 102 are made of the same material as a wall in the region of conical inner surface 110 of loudspeaker frame 100.

The material of loudspeaker frame 100 is metal or plastic, for example. In one embodiment of FIG. 1, conical inner surface 110 and snap-in hooks 101, 102 of loudspeaker frame 100 are made of the plastic polycarbonate with 10% glass fibers. The component of the loudspeaker frame 100 shown in FIG. 1 is produced by an injection molding process, for example. The material and manufacturing method used give snap-in hooks 101, 102 elasticity for a snap-in function.

Figure 2:
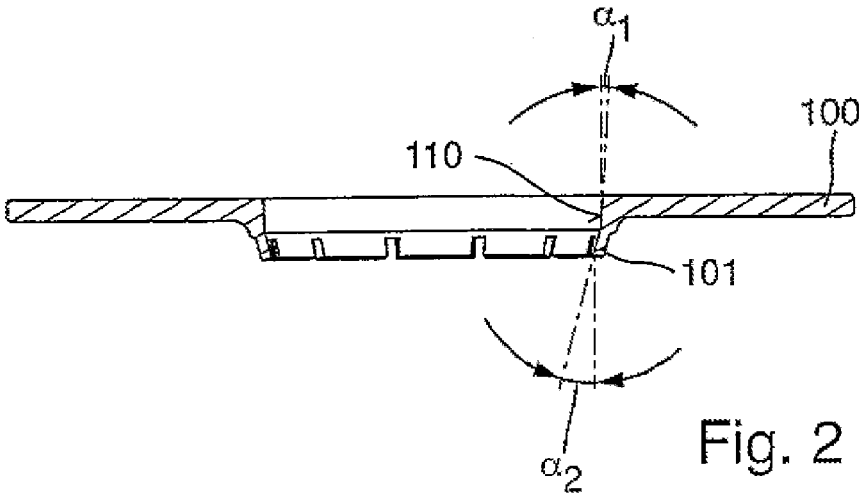

FIG. 2 shows a schematic cross-section of a component of a loudspeaker frame 100. The conical inner surface 110 of loudspeaker frame 100 in the form of a truncated cone can also be referred to as the lateral surface. The angle $\alpha 1$ (half opening angle) between the surface line and the cone axis is 4°, for example. The angle $\alpha 2$ between a snap-in hook 101 and the cone axis is 10°, for example.

Figure 3:
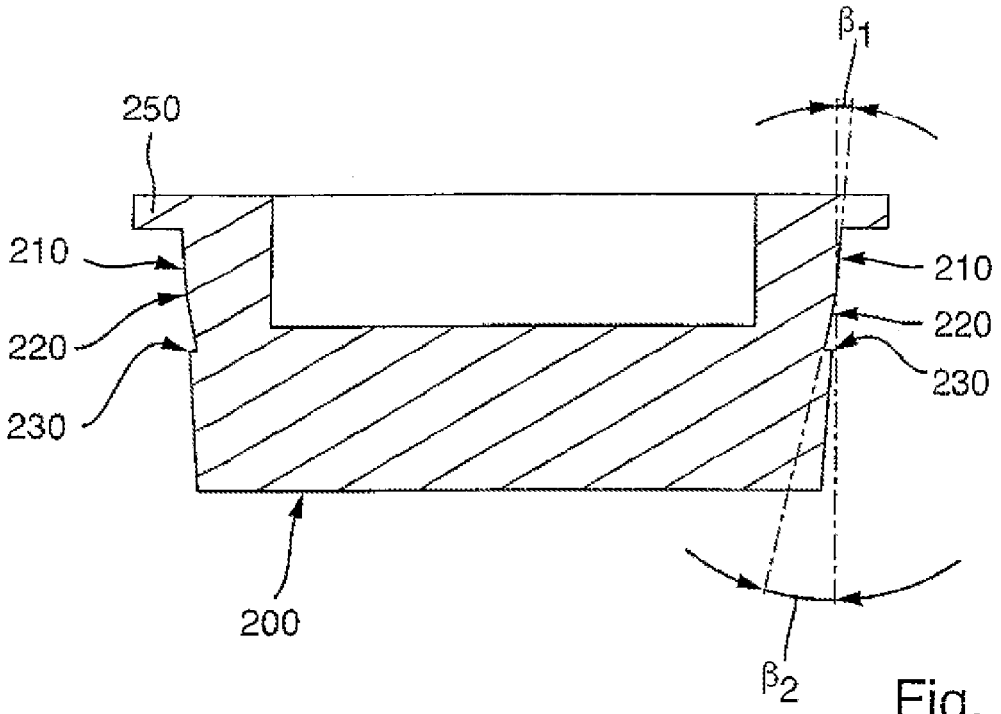

FIG. 3 shows a schematic cross-section of an embodiment of a magnet 200 of a loudspeaker. Magnet 200 in this case is made of a material for a permanent magnet, for example ferrous metals and rare earth metals. In an embodiment of FIG. 3, magnet 200 is embodied as rotationally symmetrical. Magnet 200 has a conical outer surface 210. In the embodiment of FIG. 3 the conical outer surface 210 of magnet 200 is produced by turning. The conical outer surface 210 of magnet 200 in the form of a truncated cone can also be referred to as the lateral surface. Angle $\beta 1$ (half opening angle) between the surface line and the cone axis is 3°, for example. According to one embodiment, angle $\beta 1$ (half opening angle) between the surface line and the cone axis of magnet 200 is smaller than angle $\alpha 1$ (half opening angle) between the surface line and the cone axis of loudspeaker frame 100. A further lateral surface 220 extends between lateral surface 210 and an undercut 230. Angle $\beta 2$ (half opening angle) between the surface line of further lateral surface 220 and the cone axis is greater than angle $\beta 1$.

Conical outer surface 220 of magnet 200 and conical inner surface 110 of loudspeaker frame 100 are embodied for a conical press fit. In order to attach loudspeaker frame 100 to magnet 200 by means of the press fit, loudspeaker frame 100 is slipped with its opening over magnet 100 from the side located opposite a shoulder 250 of magnet 200.

Magnet 200 has at least one undercut 230. In an embodiment of FIG. 3, undercut 230 is embodied as rotationally symmetrical. Undercut 230 is produced by turning, for example. Undercut 230 is assigned to snap-in hooks 101, 102 of loudspeaker frame 100, with snap-in hooks 101, 102 engaging in undercut 230 in the press fit assembled state. In contrast to the embodiment of FIG. 3, magnet 200 has a plurality of undercuts, enabling a plurality of engagement positions. In contrast to the embodiment of FIG. 3, loudspeaker frame 100 has a plurality of snap-in hooks 101, 102 having stepped lengths, so that a plurality of engagement positions are created in which not all of the snap-in hooks are engaged. This allows compensation for tolerances in the production of magnet 200 and of loudspeaker frame 100.

Figure 4:
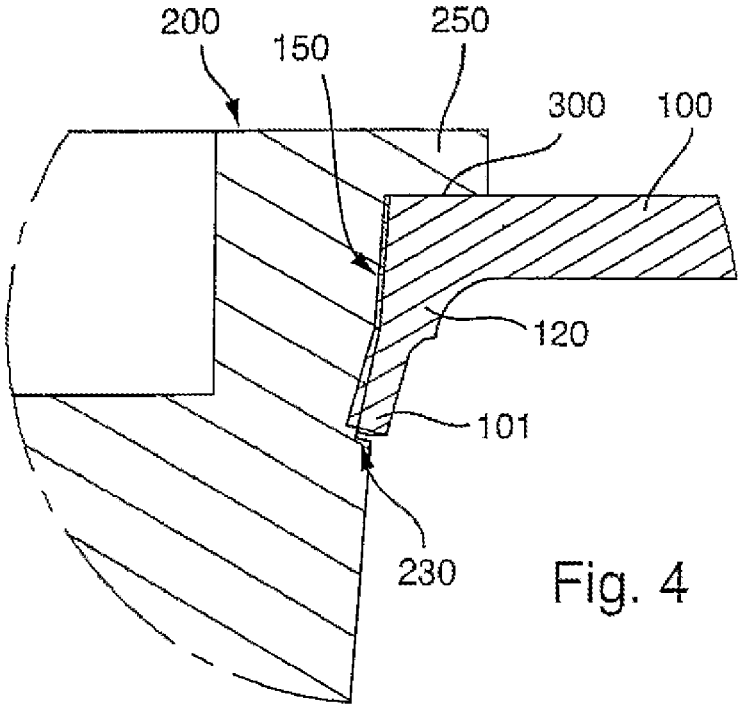

FIG. 4 shows a schematic detail cross-section of loudspeaker frame 100 attached by means of press fit 150 to magnet 200. A shoulder 250 of the magnet forms a stop for loudspeaker frame 100. An adhesive 300 may also optionally be provided between shoulder 250 and loudspeaker frame 100.

To form press fit 150, conical inner surface 110 of loudspeaker frame 100 of FIG. 1 is turned to face conical outer surface 210 of magnet 200 of FIG. 3. In this case, the material of magnet 200 in the region of conical outer surface 210 is harder than the material of a wall 120 of loudspeaker frame 100 in the region of conical inner surface 110. In an embodiment of FIG. 4, the plastic material of wall 120 of loudspeaker frame 100 is deformed in press fit 150.

In addition, FIG. 4 schematically illustrates the way in which a snap-in hook 101 of loudspeaker frame 100 engages in undercut 230 of magnet 200. In this case, snap-in hook 101 is made of an elastic material, such as plastic, for example. In an embodiment of FIG. 4, snap-in hook 101 and wall 120 of loudspeaker frame 100 are molded together from a plastic material as an integral component. In this case, the wall thickness of snap-in hook 101 is significantly narrower than the wall thickness of wall 120. An unintentional release of the attachment between magnet 200 and loudspeaker frame 100 is effectively prevented by snap-in hook 101 snapping into undercut 230. To intentionally release the attachment, snap-in hook 101 would first have to be moved out of undercut 230.

The invention is not limited to the variants as configured in FIGS. 1 to 4. For example, it is possible for a snap-in hook to be made of a different material. It is likewise possible for the snap-in hooks of the loudspeaker frame and the undercut of the magnet to be formed at different points. The functionality of the attachment by means of press fitting according to FIG. 4 can be used particularly advantageously for a center loudspeaker.

LIST OF REFERENCE SIGNS

100 loudspeaker frame
101, 102 snap-in element, snap-in hook
110 conical inner surface, lateral surface
120 shoulder
150 conical press fit
200 magnet, permanent magnet
210, 220 conical outer surface, lateral surface
230 undercut
250 shoulder
300 adhesive
$\alpha_1$, $\alpha_2$, $\beta_1$, $\beta_2$ angle

The invention claimed is:

1. A loudspeaker comprising:
a loudspeaker frame, and
a magnet,
wherein the loudspeaker frame is attached to the magnet,
wherein the magnet has a conical outer surface,
wherein the loudspeaker frame has a conical inner surface which is embodied for forming a press fit with the conical outer surface of the magnet,
wherein the magnet has an undercut,
wherein the loudspeaker frame has a number of snap-in hooks,
wherein in the press fit, at least one snap-in hook engages into the undercut, and
wherein the number of snap-in hooks is positioned completely directly above the undercut.

2. The loudspeaker according to claim 1, further comprising:
a wall that is formed as being integral with the conical inner surface and the snap-in hook of the loudspeaker frame.

3. The loudspeaker according to claim 2, wherein
a wall thickness of the loudspeaker frame in a region of the conical inner surface is greater than a wall thickness of the snap-in hook.

4. The loudspeaker according to claim 1, wherein
the conical inner surface and the number of snap-in hooks of the loudspeaker frame are made of a plastic material, in particular polycarbonate with 10% glass fibers.

5. The loudspeaker according to claim 1, wherein
the number of snap-in hooks are formed adjacent to the conical inner surface of the loudspeaker frame.

6. The loudspeaker according to claim 1, wherein the conical outer surface of the magnet is produced by turning.

7. The loudspeaker according to claim 1, wherein the conical inner surface of the loudspeaker frame is produced by injection molding.

8. The loudspeaker according to claim 1, wherein a material of the magnet in a region of the conical outer surface is harder than the material of the loudspeaker frame in a region of the conical inner surface.

9. The loudspeaker according to claim 1, wherein a material of the magnet in a region of the conical outer surface is harder than the material of the loudspeaker frame in a region of the conical inner surface.

10. The loudspeaker of claim 1 wherein the loudspeaker frame includes an upper outer flange that is at least partially covered by a shoulder of the magnet.

11. The loudspeaker of claim 1 further comprising an angle between a surface line and a cone axis of the cone axis of the conical outer surface of the magnet.

12. A loudspeaker comprising:

a loudspeaker frame including a conical inner surface and a number of snap-in hooks; and a magnet including a conical outer surface and an undercut to engage the loudspeaker frame, wherein the conical inner surface of the loudspeaker frame is shaped to form a press fit with the conical outer surface of the magnet, wherein at least one snap-in hook of the loudspeaker frame engages with the undercut within the press fit, and wherein the number of snap-in hooks is positioned completely directly above the undercut.

13. The loudspeaker according to claim 12, further comprising a wall that is formed as being integral with the conical inner surface and the snap-in hook of the loudspeaker frame.

14. The loudspeaker according to claim 13, wherein a wall thickness of the loudspeaker frame in a region of the conical inner surface is greater than a wall thickness of the snap-in hook.

15. The loudspeaker according to claim 12, wherein the conical inner surface and the number of snap-in hooks of the loudspeaker frame are made of a plastic material, in particular polycarbonate with 10% glass fibers.

16. The loudspeaker according to claim 12, wherein the snap-in hooks are formed adjacent to the conical inner surface of the loudspeaker frame.

17. The loudspeaker according to claim 12, wherein the conical outer surface of the magnet is produced by turning.

18. The loudspeaker according to claim 12, wherein the conical inner surface of the loudspeaker frame is produced by injection molding.

19. A loudspeaker comprising:

a loudspeaker frame including a conical inner surface and a number of snap-in hooks being integrally formed therewith; and a magnet including a conical outer surface and an undercut to receive the loudspeaker frame, wherein the conical inner surface of the loudspeaker frame is shaped to form a press fit with the conical outer surface of the magnet, wherein at least one snap-in hook of the loudspeaker frame engages with the undercut within the press fit, and wherein the number of snap-in hooks is positioned completely directly above the undercut.

20. The loudspeaker according to claim 19, wherein the snap-in hooks are formed adjacent to the conical inner surface of the loudspeaker frame.

21. The loudspeaker according to claim 19, further comprising a wall that is formed as being integral with the conical inner surface and the snap-in hook of the loudspeaker frame.

22. The loudspeaker according to claim 21, wherein a wall thickness of the loudspeaker frame in a region of the conical inner surface is greater than a wall thickness of the snap-in hook.

* * * * *